US005495151A

United States Patent [19]

Lu

[11] Patent Number: 5,495,151

[45] Date of Patent: Feb. 27, 1996

[54] ELECTRONIC SOUND GENERATOR WITH MECHANICAL MOVEMENT FEATURE

[76] Inventor: Clive S. Lu, 282 Newbridge Rd., Hicksville, N.Y. 11801

[21] Appl. No.: 289,169

[22] Filed: Aug. 11, 1994

[51] Int. Cl.[6] ..... A63H 29/22; A63H 3/28

[52] U.S. Cl. ..... 318/4; 318/9; 446/236; 446/297

[58] Field of Search ..... 318/3, 4, 9, 11, 318/139, 466, 470, 558, 567, 568.1, 671; 446/175, 236, 286, 297, 406

[56] References Cited

U.S. PATENT DOCUMENTS

| | | | |
|---|---|---|---|
| Re. 34,717 | 9/1994 | Sanders et al. | 315/186 |
| 3,786,596 | 1/1974 | Breslow et al. . | |
| 3,942,884 | 3/1976 | Richards et al. . | |
| 4,545,775 | 10/1985 | Kim . | |
| 4,573,939 | 3/1986 | Hoshino . | |
| 4,676,764 | 6/1987 | Yeu . | |
| 4,712,184 | 12/1987 | Haugerud . | |
| 4,850,930 | 7/1989 | Sato et al. . | |
| 4,889,027 | 12/1989 | Yokoi . | |
| 4,890,828 | 1/1990 | Hou . | |
| 4,900,289 | 2/1990 | May et al. . | |
| 4,911,676 | 3/1990 | Fan . | |
| 4,952,189 | 8/1990 | Barlow . | |
| 4,985,883 | 1/1991 | Hou . | |
| 5,020,409 | 6/1991 | Hou . | |
| 5,070,753 | 12/1991 | Hou . | |
| 5,154,615 | 10/1992 | Joubert . | |
| 5,226,845 | 7/1993 | Wu . | |
| 5,259,806 | 11/1993 | Chang . | |
| 5,385,344 | 1/1995 | Miller et al. . | |

*Primary Examiner*—Bentsu Ro
*Attorney, Agent, or Firm*—King and Schickli

[57] ABSTRACT

A modular apparatus is provided for imparting movement and selected sound to an ornament. The apparatus includes a mechanical movement module and a melody/voice module. The mechanical movement module includes a drive motor, gear assembly and cooperating power transmission rod all operatively connected together and a sound generating element in the form of a piezoelectric buzzer. The melody/voice module includes an electronic controller for controlling the generation of sound. The apparatus also includes a battery compartment for receiving and engaging a battery, a circuit for operatively electrically connecting the battery, drive motor and electronic controller and a connector for selectively connecting/disconnecting the two modules.

5 Claims, 3 Drawing Sheets

12
A
B
34
36
62
70
80
78
82
76
74
54

ELECTRONIC SOUND GENERATOR WITH MECHANICAL MOVEMENT FEATURE

TECHNICAL FIELD

The present invention relates generally to the animation field and, more particularly, to an apparatus for simultaneously imparting movement and selected sound such as speech or music melody to an ornament.

BACKGROUND OF THE INVENTION

It is long been known to animate an ornament such as a doll by means of imparting movement through a mechanical mechanism. In the case of, for example, a hoola dancing doll, appropriate music from an electronic melody circuit may also be provided. Examples of such an animated doll and the mechanisms for providing the animation including both movement and sound are found in U.S. Pat. Nos. 4,545,775 to Kim; 4,676,764 to Yeu; and 5,259,806 to Chang.

While effective for imparting both movement and sound to the ornament or doll, the mechanical mechanisms and electronics disclosed in the prior art devices suffer from one very serious design disadvantage. Specifically, the devices are individually designed for each application and are essentially only useful in one particular type of ornament. Stated another way, the devices provide a specific mechanical arrangement and specific sound tailored to the ornament for which they are designed. Further, they are not constructed with any set standards or dimensions to allow ready modification for other, like uses. Hence, each device is essentially custom designed for each ornament to be animated. This increases both design and production costs. Further, the devices have a set format of operation that may not be effectively altered by the end user. As the devices, therefore, only allow for repetitive operation without variety, their appeal is limited.

SUMMARY OF THE INVENTION

Accordingly, it is a primary object of the present invention to provide an apparatus for imparting movement and selected sound to an ornament overcoming the above-described limitations and disadvantages of the prior art.

Yet another object of the present invention is to provide a modular apparatus for imparting movement and sound to an ornament that is of relatively simple and inexpensive construction while still being characterized by particularly reliable overall performance.

Still another object of the present invention is to provide a modular apparatus of versatile design for animating an ornament such as a doll. The apparatus is appropriate for utilization in animating different dolls with different movements and different sounds by means of matching different and interchangeable modular movement units and modular sound units together. Such an approach allows a manufacturer to expand its product line while minimizing any increases in production costs. Inventory requirements are also reduced thereby reducing overhead costs.

Further, the added versatility can be enjoyed by the end user who may change the sound generated by the animated ornament by simply unplugging one interchangeable modular unit and plugging in another, different interchangeable modular unit. This effectively increases end user interest in the animated ornament along with customer satisfaction.

Accordingly, the present modular animation apparatus benefits both the manufacturer and end user.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved modular apparatus is provided for imparting movement and selected sound to an ornament. The apparatus includes a mechanical movement module constructed on a mounting platform. Specifically, a drive motor is mounted to the platform. A cooperating gear assembly is operatively connected to the drive motor. At least one power transfer means such as a threaded drive rod or a tappet rod is operatively connected to the gear assembly. This rod may be connected to the ornament to be animated so as to impart mechanical motion. Further, the mechanical movement module includes a sound generating element that is held on the mounting platform. Preferably, the sound generating element is in the form of a piezoelectric buzzer of a type well known in the art.

The modular apparatus further includes a separate melody/voice module for producing a musical tune or speech by means of a voice facsimile. The melody/voice module includes a first housing. An electronic control is held in the first housing. The electronic controller controls the generation of sound by the sound generating element held on the mounting platform of the mechanical movement module.

The apparatus further includes a battery compartment for receiving and engaging at least one battery functioning as a power source for the drive motor and the electronic controller. Preferably, the battery compartment includes means for attaching to and detaching from the mechanical movement module. Accordingly, the battery compartment may be firmly mounted and held in place on the mechanical movement module. Alternatively, if desired the battery compartment may be positioned in a location remote from the mechanical movement module for more convenient access.

The apparatus also includes a circuit means for operatively electrically connecting the battery, drive motor and electronic controller together. Additionally, the apparatus includes means for selectively operatively connecting/disconnecting the mechanical movement and melody/voice modules together. As the melody/voice module controls the sound to be generated through the sound generating element of the mechanical movement module, it is thereby possible for one to select the sound to be generated by selectively operatively connecting a melody/voice module with electronic components adaptive to produce a particular sound to the mechanical movement module. Where it is desired to generate a different sound, a different melody/voice module adapted for producing such a different sound may be connected to the mechanical movement module. Thus, either the manufacturer or the end user may select a sound to be generated during operation of the animated ornament.

The modular apparatus for animating an ornament may further include a means for providing illumination and means for operatively connecting the illumination providing means to the mechanical movement module. More particularly, the illumination means may comprise light emitting diodes (LEDs) or other appropriate means for this purpose that may be selectively illuminated in accordance with control signals provided by the circuit board. The LED's may be remotely located from the mechanical movement module and operatively connected thereto by appropriate wiring and electrical connector.

In accordance with yet another aspect of the present invention, the melody/voice module may be expanded so as to include an on/off actuator switch, a microphone, means for recording/playing a selected sound, a record/play mode selection switch and a speaker. Accordingly, such an arrangement allows the end user to record any selected sound for playback during operation of the animated ornament. Such an arrangement generally further increases user appeal and satisfaction with the ornament and, accordingly, represents an optional feature of particular interest and import.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
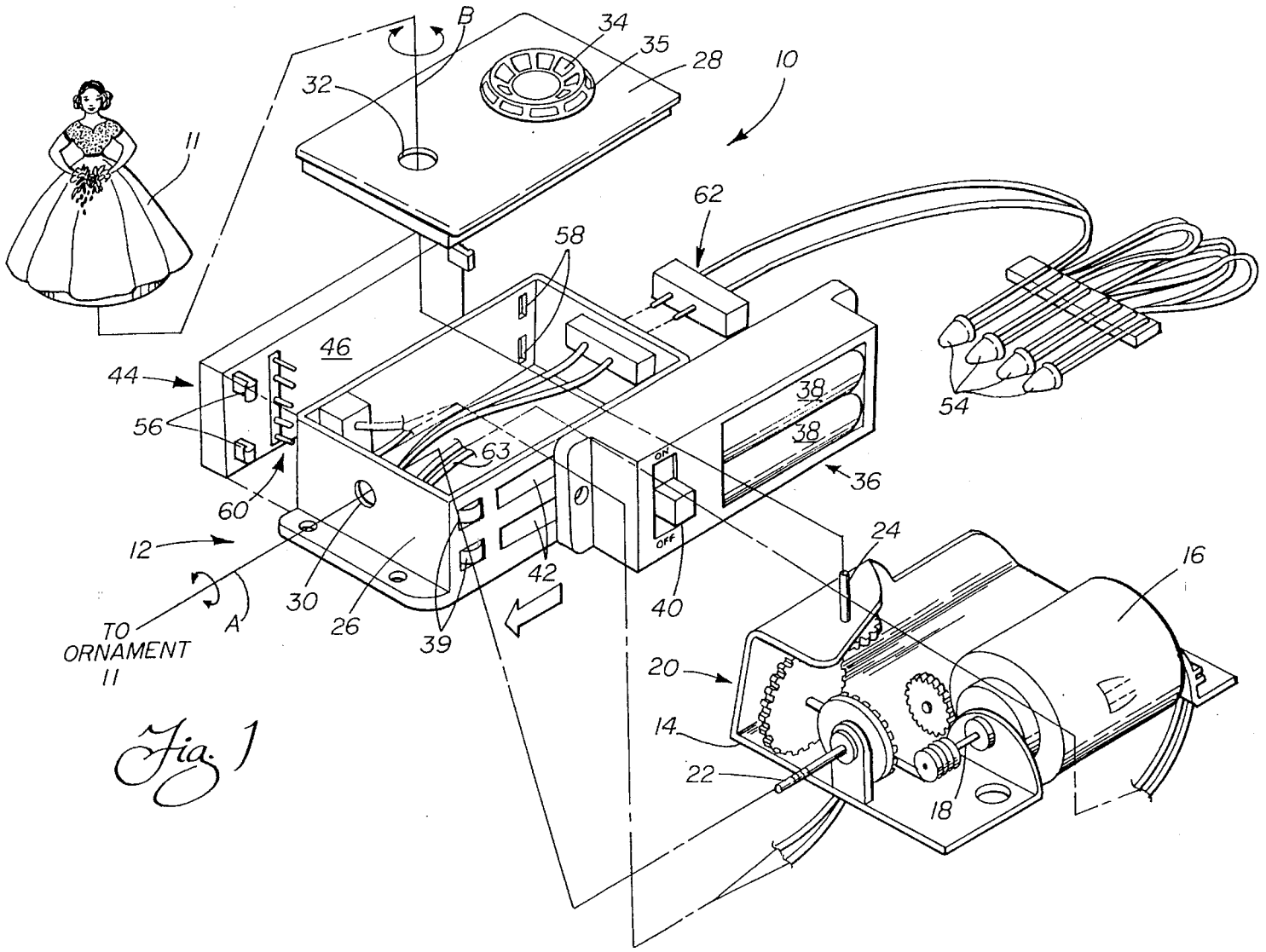
FIG. 1 is an exploded perspective view of the animation apparatus of the present invention.

Reference is now made to FIG. 1 showing the animation apparatus 10 of the present invention for imparting both movement and selected sound to an ornament such as a music box, doll, stuffed animal or other like novelty item 11. As will become more apparent as the description hereof proceeds, the apparatus 10 is of modular design. This design approach provides a number of significant benefits, the most important of which appears to be the ability to minimize production costs while increasing the versatility of the apparatus for utilization in animating a number of different ornaments through the capability of providing different movements and generating different sounds in combination.

The apparatus 10 includes a mechanical movement module 12 including a mounting platform 14. A small low-noise, high-torque electric motor 16 is mounted to the platform 14. The drive shaft 18 of the motor 16 is operatively connected to a gear assembly 20 of conventional arrangement. Gear assembly 20 preferably drives a pair of power transfer rods 22, 24. The power transfer rods 22, 24 are uniquely arranged so as to extend in planes orthogonal to one another. As shown in FIG. 1, power transfer rod 22 extends in a substantially horizontal plane and may be driven so as to rotate in a clockwise direction at a speed of approximately 4–8 revolutions per minute. Preferably, the rod 22 is reverse threaded and has a diameter of 0.29 cm ±0.1 cm and threads per centimeter averaging 22.5.

The second power transfer rod 24 is shown in FIG. 1 as extending in a substantially vertical plane. This second rod 24 is operatively connected to the gear assembly 20 so as to turn counterclockwise at a speed of approximately 1.25 revolutions per minute. Preferably, the second rod is threaded and has a diameter of 0.34 cm ±0.1 cm and a thread per centimeter average of 16.25. Thus, the mechanical movement module 12 provides power transfer for mechanically driving an ornament 11 in two orthogonal directions (note rotation axis A and B in FIG. 1). The rods 22, 24 may be driven at differing speeds and in different directions as described or, of course, an alternative arrangement could be utilized: e.g. tappet rods in the same plane.

As further shown in FIG. 1, the mounting platform 14 and the drive motor 16, gear assembly 20 and rods 22, 24 carried thereon may be mounted within a housing 26 including a removable lid 28. The access openings 30, 32 respectively in the sidewall of the housing 26 and lid 28 provide the necessary clearance for completing connection of the moveable members of the ornament to be animated (not shown) to the power transfer rods 22, 24. Of course, it should be appreciated that the mounting platform 14 may be secured within the housing 26 by means of any appropriate mechanism known in the art for such a purpose including but not limited to adhesive, screws and rivets. Similarly, the lid 28 may be retained to the sidewalls of the housing 26 in the same manner.

The mechanical movement module 12 also includes a sound generating element 34 of conventional piezoelectric design. Preferably, the sound generating element 34 is mounted in an opening in the lid 28 for good sound transmission from the mechanical movement module 12. If desired, a plastic cover 35 may be provided over the sound generating element 34 to protect it from inadvertent impact and possible damage resulting therefrom.

A battery compartment, generally designated by reference numeral 36, may be mounted to the housing 26 of the mechanical movement module 12. Preferably, the battery compartment 36 receives and engages at least one battery 38 (two batteries 38 are shown in FIG. 1) that functions to provide the electrical power for the drive motor 16 and for the sound generating element 34. An on/off actuator switch 40 may also be included as an integral component of the battery compartment 36.

Preferably, the battery compartment 36 may be selectively attached to or detached from the mechanical movement module 12. This may be accomplished by any conventional structure appropriate for providing such a function. For example, the rear face of the compartment 36 may include a pair of dove tail ridges (not shown) that are designed to be received in a pair of aligned cooperating channels 42 (wider at the bottom than the top) in one of the side walls of the mechanical movement module housing 26. Thus, when attached by means of the cooperating ridges and channels 42, the battery compartment 36 is secured to the housing 26 of module 12. Matching electrical contacts 39 on the module 12 and battery compartment 36 are thereby engaged to complete the electrical connections (see also FIG. 2). Alternatively, the battery compartment 36 may be detached and remotely located from the housing 26 and module 12 as may be necessary in certain ornaments 11 for the purpose of allowing easy access for battery changes. In this circumstance wiring (not shown) is provided between cooperating electrical contacts 39 on the battery compartment 36 and the housing 26.

As also shown in FIG. 1, the animation apparatus 10 includes a melody/voice module 44 having a housing 46. As best shown schematically in FIG. 2, the melody/voice module 44 includes an electronic controller 48 operatively connected to a pair of drivers 50, 52. As known in the art, the electronic controller 48 and drivers 50, 52 may be provided on a conventional circuit board designed for this purpose.

Driver 50 functions to provide a power signal for illuminating light emitting diodes (LEDs) 54 and driver 52 functions to control the operation of the sound generating element 34. Both operate in accordance with control signals from the electronic controller 48. Thus, a light and sound display of selected format and in accordance with the specific signature of the electronic controller 48 is provided.

As best shown in FIG. 1, the melody/voice module 44 may be mounted to a sidewall of the mechanical movement module housing 26 opposite the battery compartment 36. The housings 26, 46 of the two modules 12, 44 may be secured together by inserting the resilient tabs 56 at the ends of the housing 44 in tab receiving slots 58 in the side wall of the housing 26. The operative electrical connection leading from the drivers 50, 52 may be made by a conventional pin and socket connector 60 of a type known in the art. Similarly, the electrical connection of the optional LEDs 54 may also be completed by a conventional pin and socket connector 62 with the pin connector plugging into a socket in the side wall of the mechanical movement module housing 26. Appropriate electrical conductors in the form of wiring 63 complete the circuit path operatively connecting the battery 38, drive motor 16 electronic controller 48 and optional LEDs 54.

Figure 2:
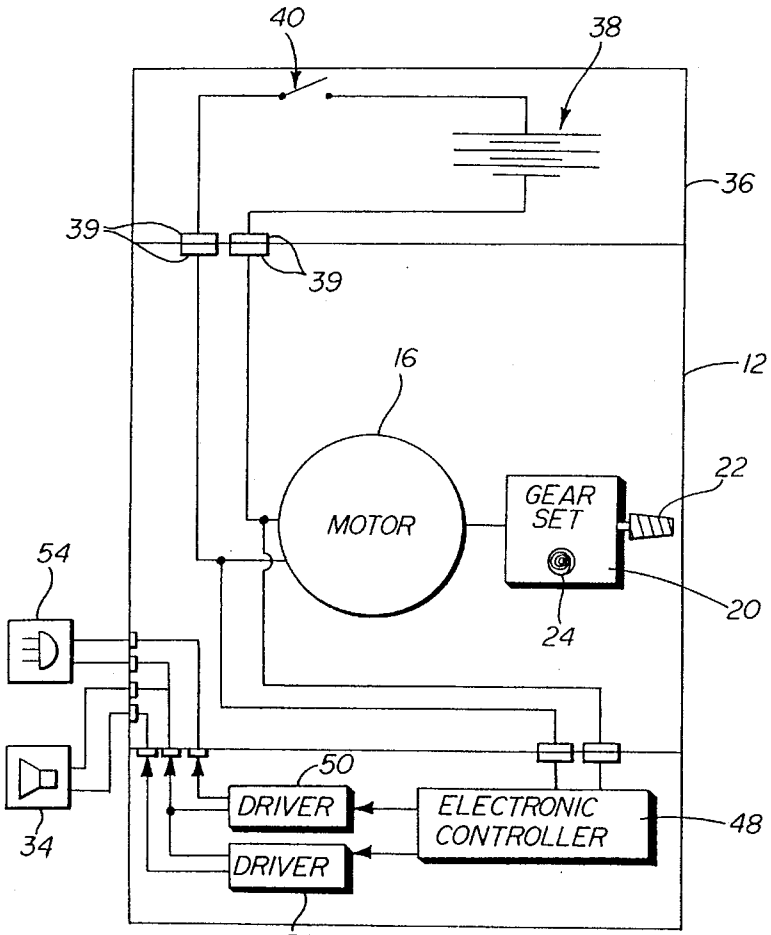
FIG. 2 is a schematical block diagram representation of the control circuit of the apparatus shown in FIG. 1.

The animation of an ornament 11 and operation of the embodiment of the modular animation apparatus 10 shown in FIGS. 1 and 2 will now be described in detail. A mechanical movement module 12, battery compartment 36 and appropriate melody/voice module 44 are selected from parts inventory. The battery compartment 36 is joined to the sidewall of the mechanical movement housing 26 by aligning and sliding the dove tail ridges into the cooperating channels 42. The melody/voice module 44 is plugged into the opposite sidewall of the mechanical movement module 26. If desired, the optional LEDs 54 are also connected to the module 12 by means of the connector 62. The entire assembly including the mechanical movement module 12, battery compartment 36 and melody/voice module 44 is then installed as one piece into the ornament 11 to be animated. Similarly, if the optional LEDs 54 are utilized, they too are installed as required. The wiring allows them to be remotely located from the module 12. The features of the ornament to be moved are also connected to the pair of power transfer rods 22, 24 so as to ready the ornament 11 for packaging and shipping to the wholesaler or retailer.

Advantageously it should be appreciated that the manufacturer may readily select different programs for sound generation. Thus, by simply plugging together a mechanical movement module 12 and a melody/voice module 44 with a different circuit for generating different sounds, the animation apparatus 10 may be modified for appropriate utilization in the animation of a different ornament 11. Similarly, modules 12 with different gear assemblies 20 and power transfer rods 22, 24 may be interchangeably connected to various melody/voice modules 44 to provide any of a number of different mechanical movement mechanism and sound combinations. This is done in a simple and efficient manner. Through the utilization of the modular design concept, production costs are minimized and better inventory control is possible, thereby also reducing overhead costs. Further, the versatility of the animation apparatus 10 is significantly enhanced over prior art animation apparatus that are essentially produced as a one piece unit for either custom operation in a particular ornament 11 or for only a limited number of ornamental issues of like design.

It should also be appreciated that the manufacturer can offer to the end user "add-on" components that may be retrofitted to the ornament 11 so as to increase user enjoyment. Specifically, different melody/voice modules 44 may be offered in the after market. The user may then unplug the original melody/voice module 44 from the mechanical movement module 12 and install a new melody/voice module. Under the control of the electronic controller 48 in the new melody/voice module, a new and different sound and/or light display may be generated from the ornament 11. This sound may take the form of a melody, tune or even speech through voice facsimile. Such versatility benefits both the manufacturer, by making the product more desirable to the end user, as well as the end user by making the product more versatile and interesting.

Figure 4:
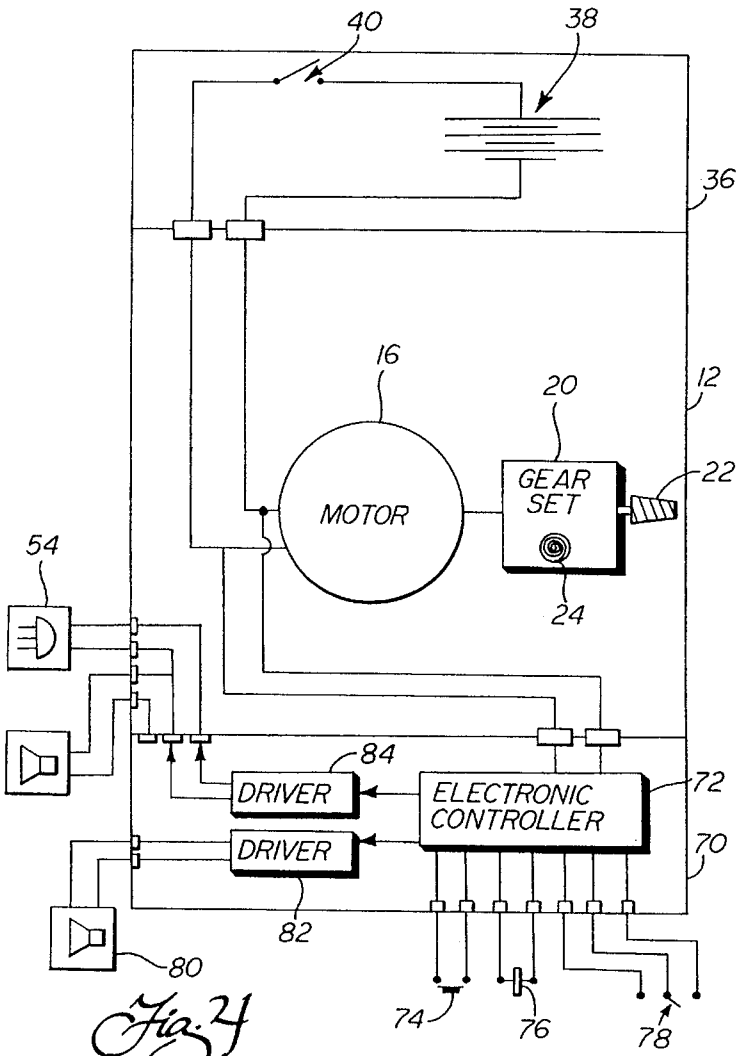
FIG. 4 is a schematical block diagram representing the control circuit of the alternative embodiment as shown in FIG. 3.
Figure 3:
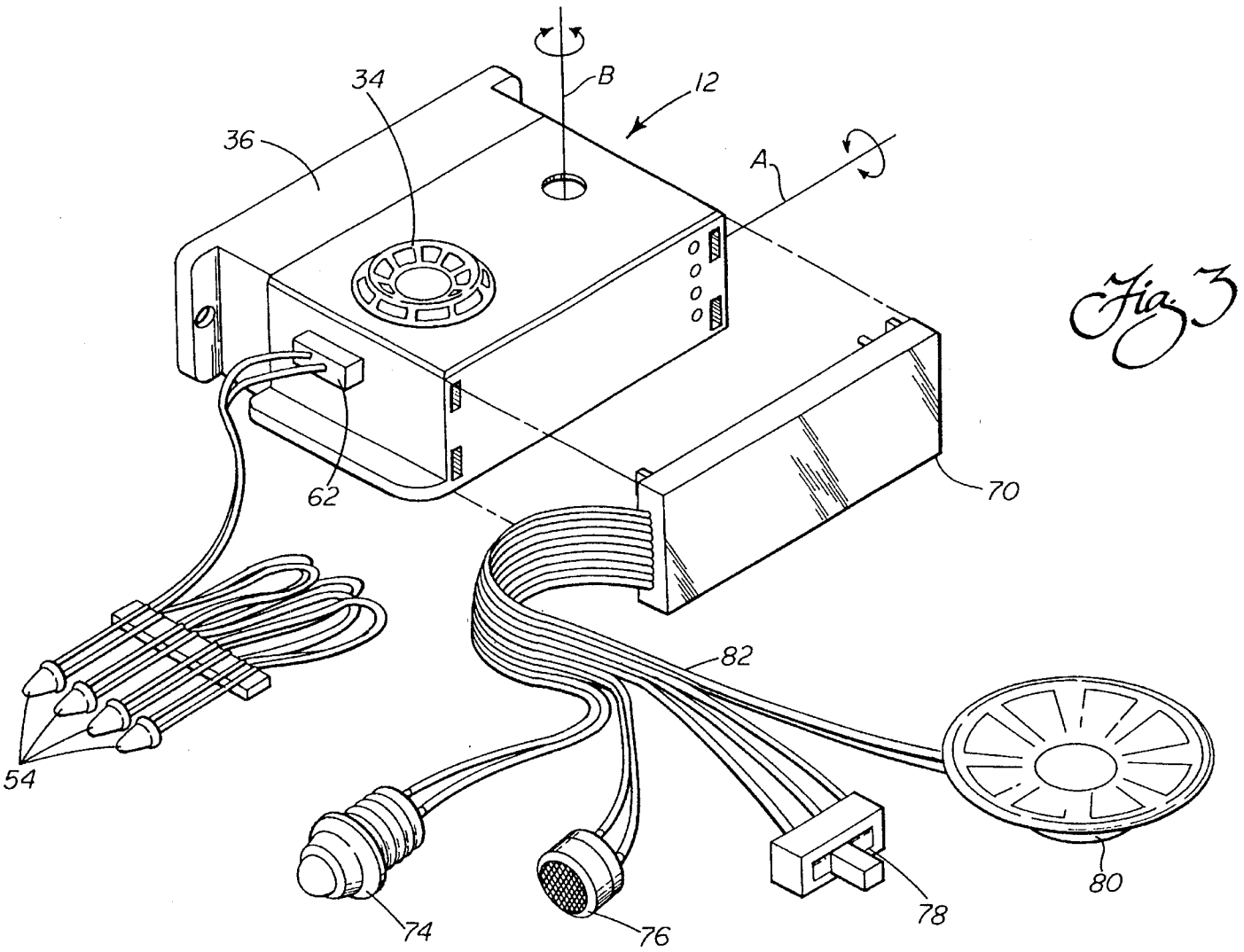
FIG. 3 is a partially exploded view of an alternative embodiment of the present invention to that shown in FIG. 1.

In accordance with yet another aspect of the present invention an alternative embodiment for the modular apparatus 10 is disclosed in FIGS. 3 and 4. In the alternative embodiment, all the components and circuitry of the mechanical movement module 12 and battery compartment 36 remain unchanged and, accordingly, these are indicated with the same reference numerals. Additionally, the optional LEDs 54 are shown operatively connected to the mechanical movement module 12 through the pin and socket connector 62. A more advanced and versatile melody/voice module 70 is, however, shown.

The melody/voice module 70 includes an electronic controller 72 that allows selective recording and playback of end user selected sounds. As shown the electronic controller 72 is operatively connected to an actuator switch in a form of a replay push button 74, a microphone 76 to enable the recording of sounds, a record/play mode selection switch 78 and a speaker 80. As shown, the replay push button 74, microphone 76, record/play mode selection switch 78 and speaker 80 may all be connected to the electronic controller 72 by means of electrical wiring 82 so as to allow remote positioning at a convenient control location on or within the ornament 11 that the apparatus 10 is being utilized to animate.

The electrical circuitry connection between the electronic controller 72 and the replay push button 74, microphone 76, record/play mode selection switch 78 and speaker 80 is best shown in FIG. 4. As shown, the electronic controller 72 is directly connected to the replay push button 74 and microphone 76 and record/play mode selection switch 78. Connection to the speaker 80 is made through the drive 82. The melody/voice module 70 also includes a separate driver 84 for controlling the operation of the optional LED's 54.

In this embodiment, the user may select the record mode utilizing the switch 78. By speaking or playing a musical tune into the microphone 76, a desired sound recording may be produced and retained in the electronic controller 72. The length of the recording depends upon the capacity of the integrated circuits of the electronic controller 72. It could, for example, be anywhere from 10 to 30 seconds in length. After recording, the selector switch 78 is returned to the play mode. Then, upon actuating the replay push button 74, the selected recorded message is generated through the sound generating element 34 as controlled by the electronic controller 72 through the driver 84. This alternative embodiment adds further sophistication to the apparatus 10 increasing its potential uses and markets.

In summary, numerous benefits result from employing the concepts of the present invention. Manufacturers, marketers and end users all benefit from the increased versatility of the animation apparatus of the present invention. The modular design allows the control of production costs and overhead. The ability to readily select and change the combination of movements and sounds to be generated through the apparatus 10 increases the function and utility to the benefit of all parties. The alternative embodiment further increases the sophistication of the device allowing the end user to actually record his/her own selected sounds for generation whether they are voice messages or musical presentations.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, a flexible wiring connection may be used between the mechanical movement and melody/voice modules 12, 44 or 70 so that they may be located remote from one another. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

I claim:

1. A modular apparatus for imparting a desired movement and selected sound, comprising:

an animated ornament;

a mechanical movement module including a mounting platform, a drive motor mounted on said mounting platform, a gear assembly operatively connected to said drive motor, at least one power transfer means operatively connected to said gear assembly for imparting movement to said animated ornament and a sound generating element in the form of a piezoelectric buzzer held on said mounting platform;

a melody/voice module including an electronic controller for controlling the generation of sound by said sound generating element;

a battery compartment for receiving and engaging at least one battery functioning as a power source for said drive motor and said electronic controller;

circuit means for operatively electrically connecting said at least one battery, said drive motor and said electronic controller together; and means for selectively operatively electrically connecting/disconnecting said mechanical movement and melody/voice modules whereby one may select the sound to be generated by selectively operatively connecting melody/voice modules with different electronic controllers to said mechanical movement module.

2. A modular apparatus for imparting movement and selected sound to an ornament, comprising:

a mechanical movement module including a mounting platform, a drive motor mounted on said mounting platform, a gear assembly operatively connected to said drive motor, at least one power transfer means operatively connected to said gear assembly for transferring power to the ornament and a sound generating element held on said mounting platform;

a melody/voice module including an electronic controller for controlling the generation of sound by said sound generating element, said melody/voice module including an actuator switch, a microphone, means for recording/playing a selected sound, a record/play mode selection switch and a speaker;

a battery compartment for receiving and engaging at least one battery functioning as a power source for said drive motor and said electronic controller;

circuit means for operatively electrically connecting said at least one battery, said drive motor and said electronic controller together; and means for selectively operatively electrically connecting/disconnecting said mechanical movement and melody/voice modules whereby one may select the sound to be generated by selectively operatively connecting melody/voice modules with different electronic controllers to said mechanical movement module.

3. The apparatus as set forth in claim 2, wherein said battery compartment includes means for selectively attaching to/detaching from said mechanical movement module.

4. The apparatus as set forth in claim 3, further including means for providing illumination under control of said electronic controller and means for operatively connecting said illumination providing means to said mechanical movement module.

5. The apparatus as set forth in claim 2, further including means for providing illumination under control of said electronic controller and means for connecting said illumination providing means to said mechanical movement module.

* * * * *